US006164873A

United States Patent [19]

Miotti et al.

[11] Patent Number: 6,164,873

[45] Date of Patent: Dec. 26, 2000

[54] DOUBLE-WING DEFORMABLE STOP-END PIPE FOR FORMING THE JOINING SURFACES OF CONCRETE-CAST WALL ELEMENTS

[75] Inventors: Giosue' Miotti; Marco Miotti, both of Frazione de Mestre, Italy

[73] Assignee: Finic B.V., Rotterdam, Netherlands

[21] Appl. No.: 09/140,685

[22] Filed: Aug. 26, 1998

[30] Foreign Application Priority Data

Sep. 12, 1997 [IT] Italy ..... MI97A2075

[51] Int. Cl.[7] ..... E01C 11/02; B29C 33/26

[52] U.S. Cl. ..... 405/267; 404/48; 249/9; 249/183; 52/396.02

[58] Field of Search ..... 405/107, 108, 405/109, 267, 275; 404/48; 249/1, 4, 9, 10, 22, 35, 178, 183, 188, 191–193; 52/396.02; 264/34

[56] References Cited

U.S. PATENT DOCUMENTS 3,796,054 3/1974 Piccagli ..... 405/267

FOREIGN PATENT DOCUMENTS 101350 2/1984 European Pat. Off. .

402247 12/1990 European Pat. Off. .

*Primary Examiner*—Eileen D. Lillis

*Assistant Examiner*—Sunil Singh

*Attorney, Agent, or Firm*—Oblon, Spivak, McClelland, Maier & Neustadt, P.C.

[57] ABSTRACT

A stop-end pipe is used for formation of joining surfaces between adjacent wall elements made from a concrete casting, of the type consisting of a substantially trapezium-shaped profiled section divided up into at least two wings these wings are resiliently approachable to one another and also have a double internal reinforcing partition able to prevent collapsing as a result of compression. Preferably, the double partition is partially widened out so as to form a guide channel in which a guiding pawl for a working tool is able to slide.

12 Claims, 7 Drawing Sheets

DOUBLE-WING DEFORMABLE STOP-END PIPE FOR FORMING THE JOINING SURFACES OF CONCRETE-CAST WALL ELEMENTS

BACKGROUND OF THE INVENTION

1. Field of the Invention

The present invention relates to a stop-end pipe for creation of the joining surfaces between underground wall elements formed by casting concrete in situ.

2. Description of the Prior Art

This technique, which has been known for some years now, involves the following steps:

performing an excavation in the form of a trench, always in the presence of bentonite slurry, using various tools, including special buckets having a width and a length which are substantially the same as, or a submultiple of, the width and length of the excavation, the width as well as the depth of the excavation corresponding respectively to the width and the depth of the finished underground wall;

immersing in the excavation, still full of bentonite slurry, a metal reinforcement for the underground wall, if required;

filling the excavation with concrete, starting from the bottom, the bentonite slurry floating on the concrete and being expelled upwards as the level of the latter gradually rises from the bottom; and leaving the concrete thus cast in the first excavation to set and carrying out the operations again, from the beginning, for a second excavation arranged next to and in line with the first excavation.

Precisely this latter step in the process is particularly delicate since, along the surface of the vertical head side of the wall set in the first excavation, it is extremely difficult to form a perfect joint with the wall cast in the second excavation which does not give rise to problems either of a structural nature or associated with infiltrations.

Various techniques have been proposed in order to solve this problem; the invention relates in particular to those techniques, more recent, whereby, once a first excavation has been carried out, before performing casting of concrete therein, a so-called "stop-end pipe" or formwork with a special cross-sectional shape is inserted therein, said "stop-end pipe" or formwork being arranged vertically in the excavation so as to print, in the head surface of the wall cast in the first excavation, a shaped surface impression intended to facilitate subsequently joining with the wall which will be cast in the second excavation.

A first embodiment of the stop-end pipe has been known since 1977, according to which simple tubular elements having circular cross section were stacked one over the other inside the excavation.

However, upon the cast being performed, the concrete spills out onto the lateral sides of the circular tubular elements giving rise to the undesirable formation of concrete rings which encircles the surfaces of the formwork, further hindering removal thereof.

In the following years, this kind of circular pipe was dismissed and a new stop-end pipe was disclosed, in which the cross section of the tube was so shaped as to facilitate braking of concrete rings at predetermined positions, with great advantage for performing the next adjacent excavation. Further, in the shaped stop-end pipes, the side facing the concrete cast is formed in such a way as to print, in the head surface of the wall cast in the excavation, an impression intended to facilitate subsequently joining with the wall which will be cast in the adjacent excavation.

However, the extraction operation of both types of stop-end pipes from the excavation still proves to be fairly difficult and must be performed before the concrete has set fully—for example within three or four hours of casting—with the risk of at least part of the concrete collapsing.

In order to overcome this difficulty, solutions have been proposed in which the formwork is extracted by exerting a pulling force in the horizontal direction, obviously after the second excavation has been performed.

More precisely, there is known a formwork which has an essentially trapezoidal cross-sectional shape, and having guiding elements apt to guide an extracting tool. The main drawback of this arrangement consists in the fact that the formwork despite also has a trapezoidal shape intended to facilitate extraction, in practice remains attached to the casting of the side of the first excavation with a resistance which increases the longer the concrete is allowed to set. In order to overcome this adhesive resistance, it is therefore necessary to use a very heavy and efficient hammering tool, said tool being able to apply to the formwork impacts directed towards the head of the wall and respectively in the opposite direction, precisely in order to cause separation of the formwork. It can be easily understood that this arrangement requires a complex way of working and that a formwork which is subject to this treatment has only a very short working life.

SUMMARY OF THE INVENTION

The object of the present invention is to provide a deformable stop-end pipe which can be extracted even after hardening of the cast concrete and which, used in accordance with a corresponding working method, allows easy and non-destructive extraction. This object is achieved as a result of the characteristic features indicated but in particular:

on the one hand, owing to the fact that the deformable stop-end pipe consists of at least one double-wing profiled section which, during casting of the concrete, has a sufficiently rigid structure; and on the other hand, owing to the fact that, after hardening of the concrete casting and the action of a cleaning tool guided along a guide-channel formed in the profiled section, the profiled section itself can be easily deformed in a resilient manner and made to close up on itself by the movement, towards each other, of said wings about a resilient hinge.

Further characteristic features and advantages of the stop-end pipe and its use according to the invention will appear, however, more clearly from the detailed description which follows of some preferred embodiments, provided solely by way of example and illustrated in the accompanying drawings.

DESCRIPTION OF THE PREFERRED EMBODIMENTS

Figure 1A:
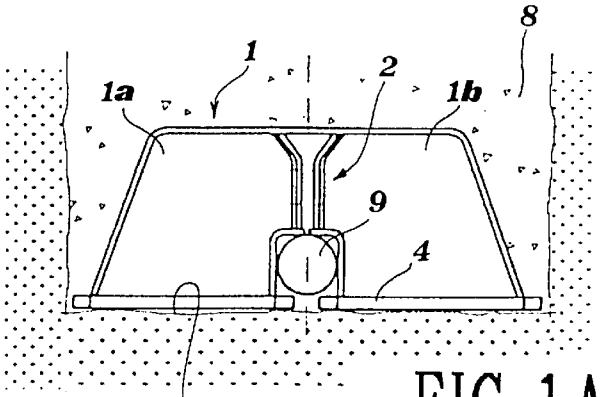
FIGS. 1A and 1B show a cross-sectional view of an embodiment of the stop-end pipe tube according to the invention, respectively during casting and during separation in the deformed condition.

As can be clearly seen from FIG. 1A, the stop-end pipe according to the invention is formed by a profiled section 1 with a cross-section substantially in the form of an isosceles trapezium, divided up into two wings, in the form of closed shells 1*a* and 1*b*, by a double center partition 2.

Figure 1B:
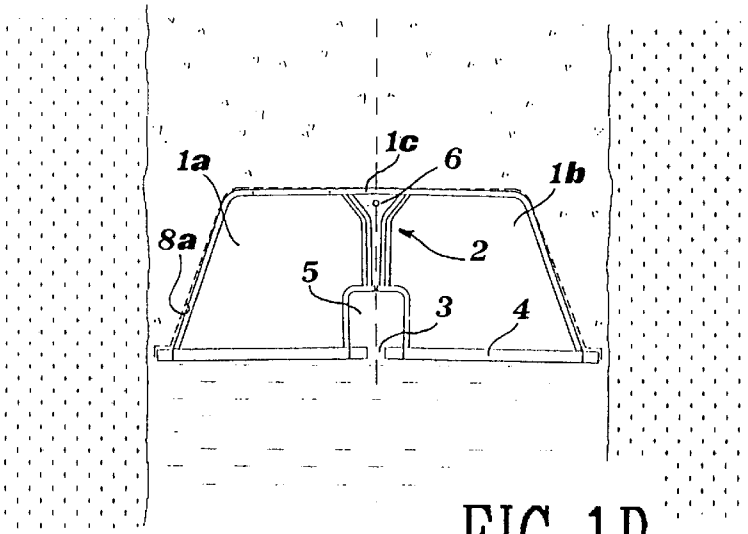
Figure 1C:
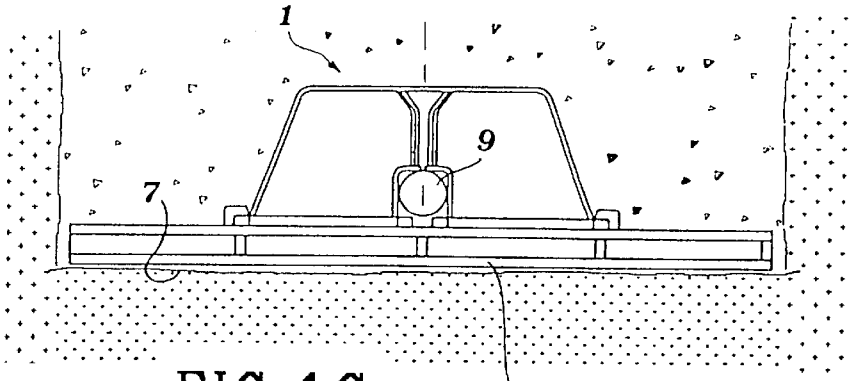
FIGS. 1C–1E are views, similar to that of FIG. 1A, of different embodiments of the invention.

The shells 1*a* and 1*b* in FIG. 1B have a common wall 1*c* which forms the smaller base of the trapezium and by means of which they are joined together. The two partitions 2 connect, inside the profiled section 1, the two bases of the trapezium and widen out in the region of a first slit 3 in a larger base 4, which interrupts the continuity of the latter, forming a guide channel 5, the use of which will be clarified below.

According to a preferred embodiment of the invention (FIGS. 1F and 1G), the stop-end pipe consists of two plates $P_1$ and $P_2$, forming the larger base of the trapezium, from which project the two partitions 2. These partitions 2 have diverging portions $D_1$ and $D_2$ which bend outward to form a Y-shaped structure. A U-shaped metal plate 100 is arranged, in the form of a bonnet, over the portions $D_1$, $D_2$ and the plates $P_1$, $P_2$—fixed to edges of the diverging portions, for example by welds S—so as to complete the two oblique sides and the smaller base of the profiled section. This structure is particularly advantageous for obtaining the desired deformability characteristics explained hereinafter.

The thickness of the metal plate from which the profiled section is made, in particular of the common wall 1*c*, is sufficiently thin to retain a reasonable degree of deformability. Preferably the deformability is such as to allow a movement, towards each other, of the two shells 1*a* and 1*b*—as shown in FIG. 1B, in which the perimeter of the undeformed profiled section is indicated by a broken line and that of the deformed profiled section by a solid line—by rotation about an imaginary hinge 6 located on the axis of symmetry very close to the common wall 1*c*. The movement, towards one another, of the two shells 1*a* and 1*b* is permitted, not only by the deformability of the common wall 1*c*, but also by the fact that the two partitions 2 are sufficiently spaced from one another and the fact that the larger base 4, as well as the guide channel 5, are interrupted at the location of the first slit 3 and a second slit 5*a* (FIG. 1G) respectively.

The presence of the double partition 2 in FIG. 1A also ensures the necessary rigidity of the profiled section 1 which otherwise, in view of the relative low thickness of its walls, could collapse under the pressure of the surrounding concrete.

The function of the stop-end pipe is obvious from the illustrations of FIGS. 1A through 2B the shape of the stop-end pipe impressed in reverse in the head end face of the wall (FIG. 2B) forms the desired joining surface. In fact, the presence of a trapezium-shaped flaring extending over the whole depth of the wall head-end face is sufficient to form a surface of greater adhesion for the casting which will fill the trench excavated subsequently.

Figure 2A:
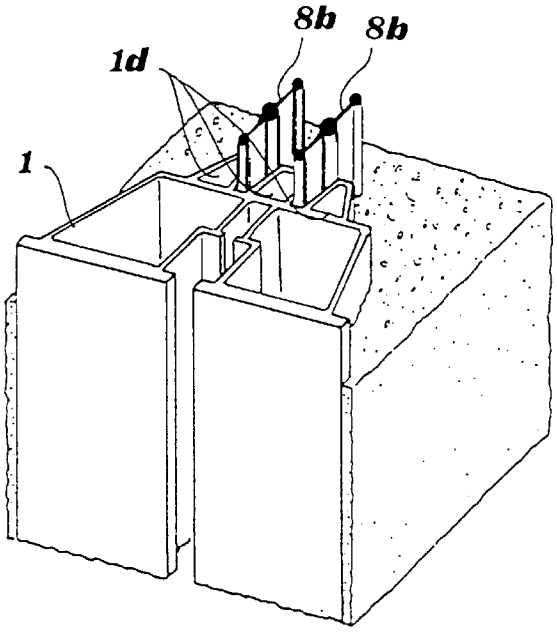
FIGS. 2A and 2B are partial perspective views which show the joining surface of the wall, with two sealing strips, respectively with and without the stop-end pipe.

A joining surface 8*a*, not being flat, also represents an obstacle preventing the infiltration of liquid from the ground next to the wall. In order to improve the sealing function of the joining surface 8*a*, two rubber sealing strips 8*b*—so-called "water stops"—may be provided. These strips 8*b* may be placed in the concrete wall by mounting them provisionally, for example, in suitable retaining means 1*d* in the common wall of the stop-end pipe, as can be seen in FIG. 2A. The sealing strips 8*b*, once the profiled section 1 has been extracted, remain embedded in concrete 8 (see FIG. 2B), forming a further barrier against the infiltrations of liquids along the joining surface 8*a*.

According to a preferred embodiment of the invention show in FIGS. 1A and 1B, an ordinary disposable tube 9, for example made of plastic, is inserted into the guide channel 5 over its entire length. The presence of the tube 9 in the guide channel 5 prevents any concrete, which should spill out onto the edges of the profiled section 1, passing between the larger base 4 and a head-end face 7 of the ground, from penetrating into the guide channel 5, through the first slit 3. Thus, obstructing it.

As an alternative or in addition to the tube 9, there is provided a rectangular abutting formwork 10 (FIG. 1C) or a simple disposable plywood board 11 (FIG. 1D) which, applied to the larger base of the profiled section 1, perform the main function of enlarging the same larger base of the stop-end pipe, hence being employed to obtain a wider head-end face 7 (FIG. 1C) of the cast wall.

Figure 1D:
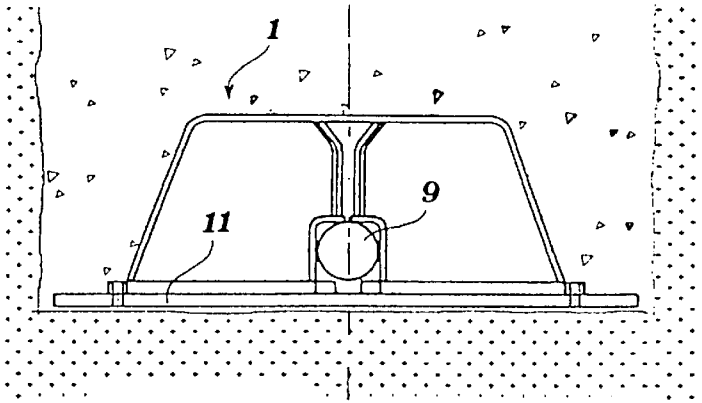
Figure 3A:
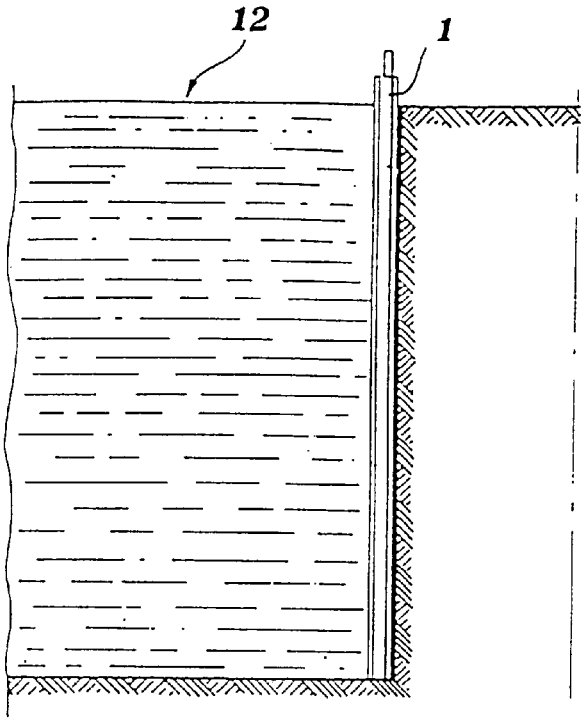
FIGS. 3A–3C are longitudinally sectioned views which show the various stages of construction of the wall in the trench.
Figure 3B:
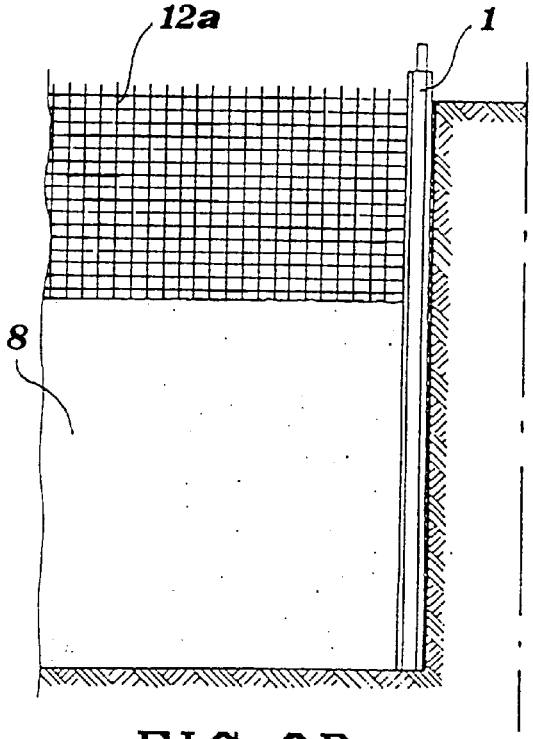
Figure 3C:
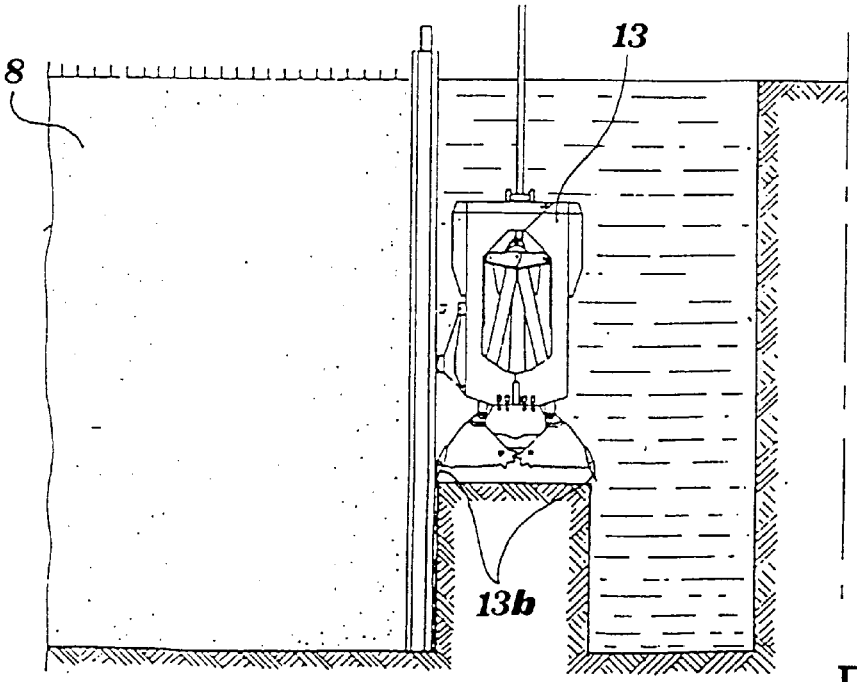

The formwork 10 (FIG. 1C) and the plywood board 11 (FIG. 1D), besides protecting the guide channel 5 (FIG. 1B), have also the function of forming a layer, between the larger base 4 of the profiled section and the head-end face 7 (FIG. 1A) of the ground, offering low resistance to the "biting" of teeth 13*b* of the bucket during excavation of the following trench (FIG. 3C). In fact, the blades of the bucket could encounter obstacles in the ground—such as greater compactness, rocks or rubbish of various sorts—which would prevent them from proceeding in a regular manner. Instead, the board 11 of FIG. 1D is made of fairly breakable material which certainly does not offer any resistance to the biting action of the teeth 13*b* of the (FIG. 3C) bucket; even more so, the gap left free by removal of the formwork 10 (FIG. 1C) clearly forms an excellent insertion point for said teeth.

This choice is particularly advantageous when a low resistance (4–5 $Kg/cm^2$) slow settable (10–20 days) conglomerate is used instead of concrete. In this case, if there did not exist the low resistance insertion point, the bucket would proceed easier towards the cast conglomerate, thus offering a lower resistance than the more compact ground.

Figure 1E:
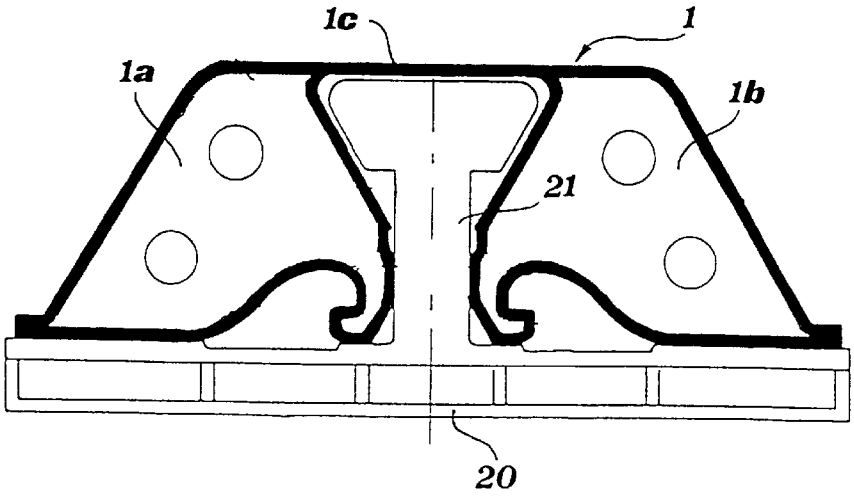
Figure 1F:
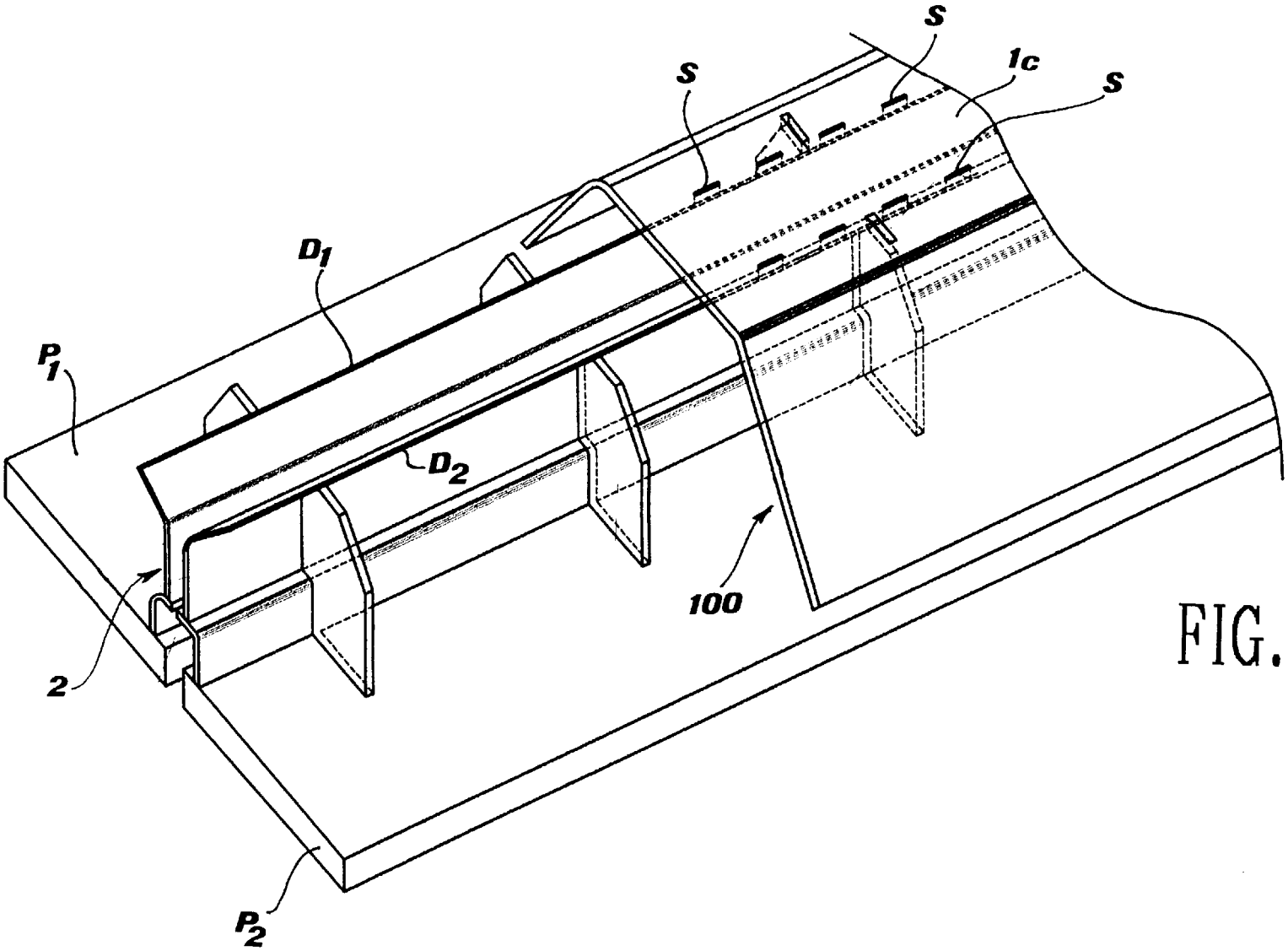
FIGS. 1F and 1G respectively illustrate a perspective view and a frontal elevation view of a preferred embodiment of the invention.
Figure 1G:
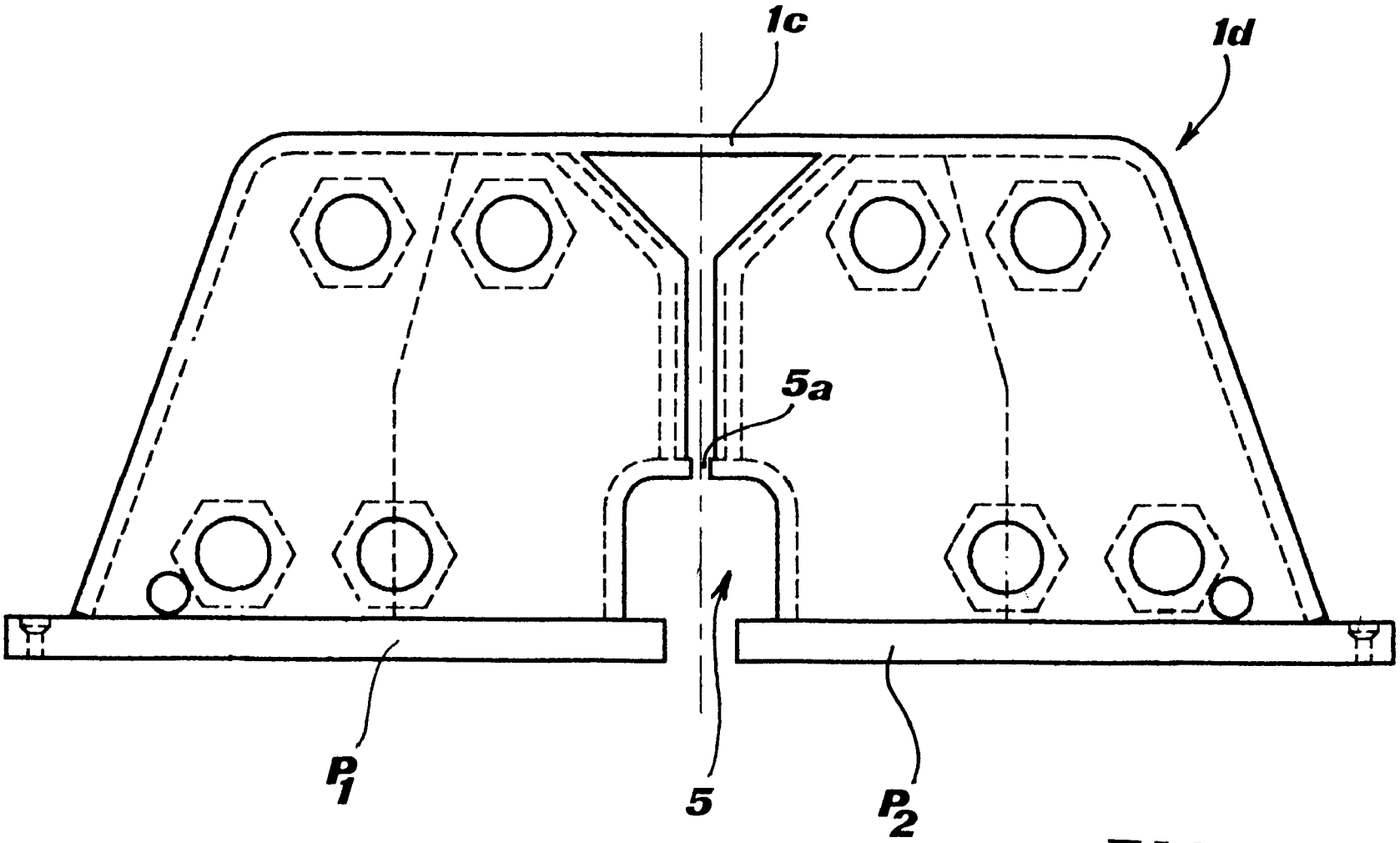

According to another embodiment of the invention illustrated in FIG. 1E, the profiled section 1 has associated with it a formwork 20, the function of which is similar to that of the formwork already discussed, but which also has a retractor tool 21 apt to be inserted between the two shells 1*a* and 1*b* so as to prevent the deformability of the common wall 1*c* producing, as a result of the external pressure of the concrete, closing of the two shells 1*a* and 1*b* against one another before the required time. When the formwork 20 and the retractor tool 21 are extracted, a space is left between the two shells 1*a* and 1*b* sufficient to allow deformability of the profiled section 1.

The steps for installation of the stop-end pipe according to the invention and the various stages relating to construction of the underground wall will now be described with reference to FIGS. 3A through 5B.

First of all a trench 12 of the required depth and width is excavated, being kept constantly filled with bentonite in order to prevent caving-in of the side walls, and finally a suitable reinforcement 12*a* is inserted, as seen in FIG. 3B.

The stop-end pipe has a length which varies depending on the type of use and the dimensions of the wall to be constructed, but in any case it will be preferably divided up into separate elements, which can be handled more easily on-site, having a length which is undoubtedly lesser than the depth of the trench. Therefore, several stop-end pipes, stacked on top of one another, are rested with the larger base 4 against the vertical head end face 7 of the ground (FIG. 1A) over the whole depth of the trench.

Returning to FIG. 3B, a pumping tube which introduces concrete 8 from the bottom of the excavation is then inserted, so as to raise the bentonite, which floats on top of it, and cause it to flow out from the top of the excavation.

The strong pressure (even as much as 10 atm) exerted by the concrete 8 on the profiled section 1 is mainly taken up by the double partition which prevents crushing thereof.

Figure 4:
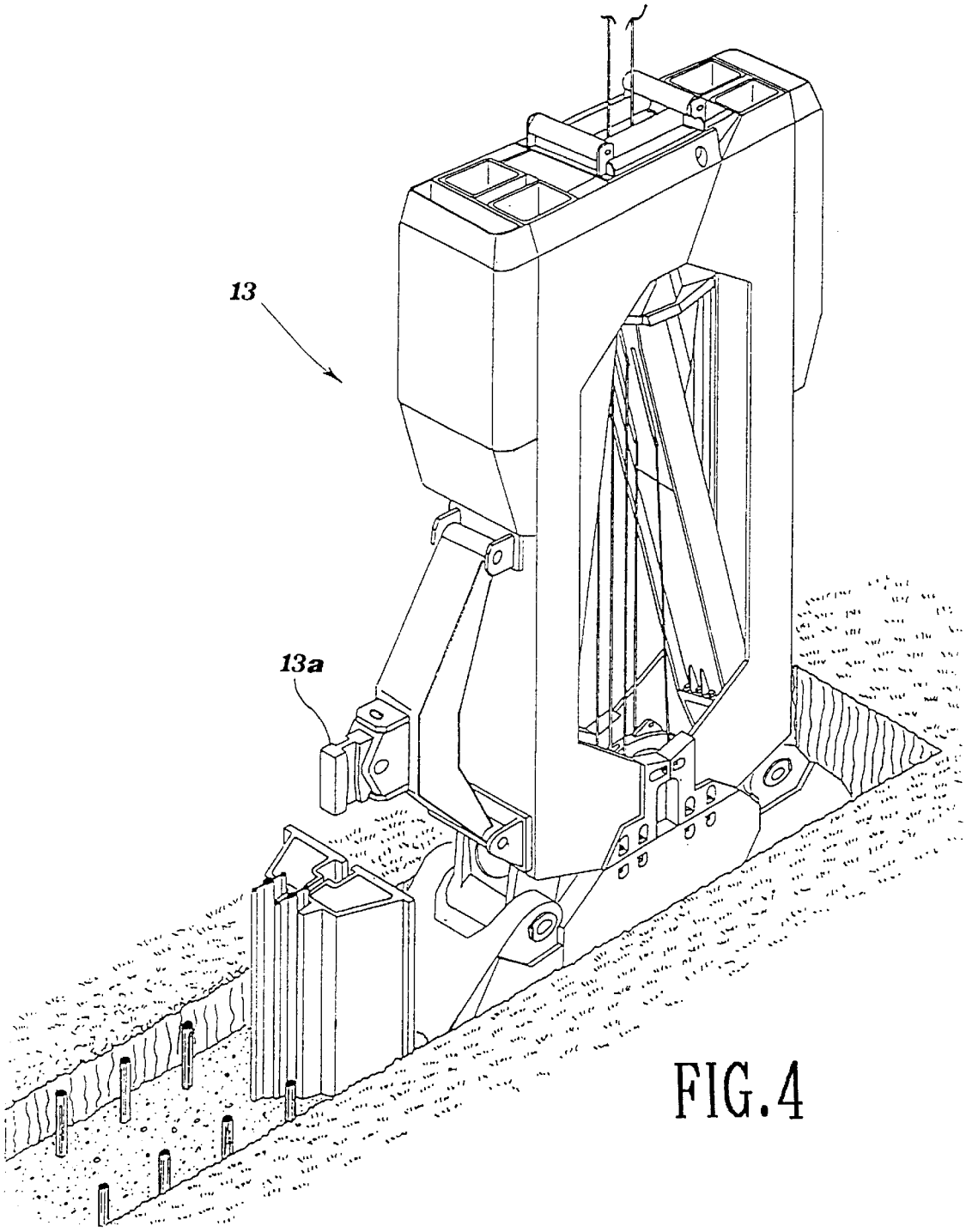
FIG. 4 is a perspective view which shows a stage involving excavation of the trench.

After the concrete 8 has completely set as shown on the left side of FIG. 3C a second excavation is performed, aligned with the first one. The excavation operation is performed by a special bucket 13 (FIGS. 3C and 4). Advantageously, according to the invention in FIG. 4, a guiding pawl 13*a* of the bucket 13 is engaged into the guide channel 1 of the stop-end pipe and ensures reliable guiding of the bucket 13 itself. This engaging arrangement is particularly desirable when it is required to form high walls, so that it is hard to excavate a very deep trench which remains planar, as far as possible, with the adjacent trench, without suitably guiding the excavation bucket.

In order to perform this operation, it is necessary in all cases to remove—where it has been used—the formwork 10 (FIG. 1C) beforehand, so that the gap left free is able to perform the function mentioned above. For example, the formwork 10 may be removed from the profiled section 1 a few hours after completion of the casting. This operation does not give rise to any problems since:

on the one hand, the concrete has already set sufficiently to prevent the stop-end pipe from being moved by the thrusting force of the concrete and occupying the empty end portion of the excavation, or to prevent the concrete from spilling out onto the side edges of the larger base of the profiled section 1 so as to occupy in turn said empty space of the excavation;

on the other hand, the concrete is still soft enough not to offer excessive resistance to removal with any of its protrusions which, on account of the irregularities of the excavation, may have surrounded the side edges of the formwork 10. After extraction of the formwork 10 from the profiled section 1, the latter is left inside the excavation for the whole time needed to obtain the desired curing of the concrete.

No direct action need be taken with regard to either the plywood panel 11 (embodiment of FIG. 1D) or the tube 9, which will simply be demolished by the passing movement of the teeth 13*b* of FIG. 3C and the pawl 13*a* of FIG. 4.

Figure 5A:
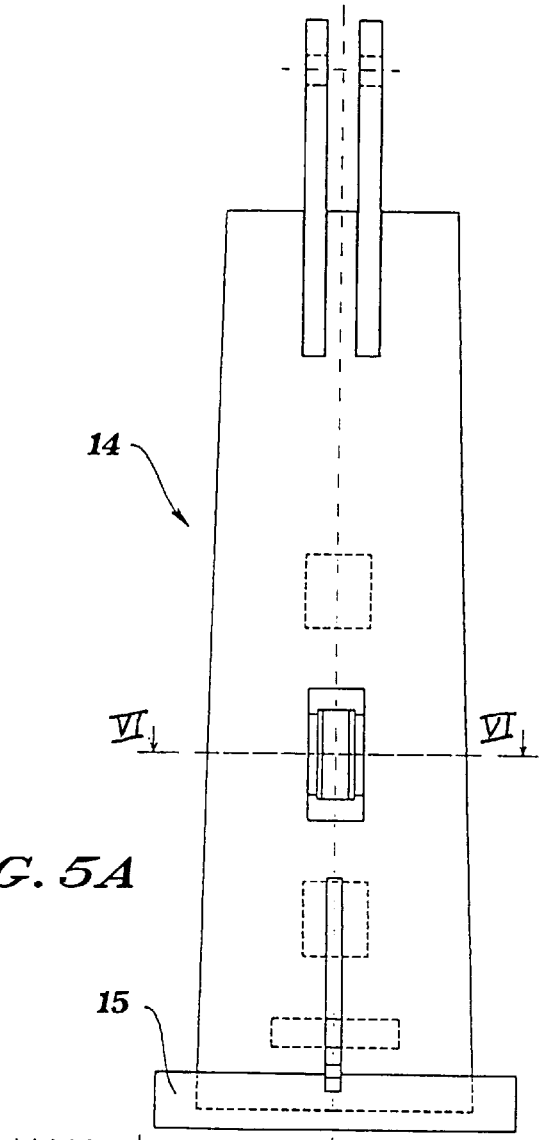
FIGS. 5A and 5B are side elevational views, respectively from the front and side, of the chisel used in association with the stop-end pipe according to the invention.
Figure 5B:
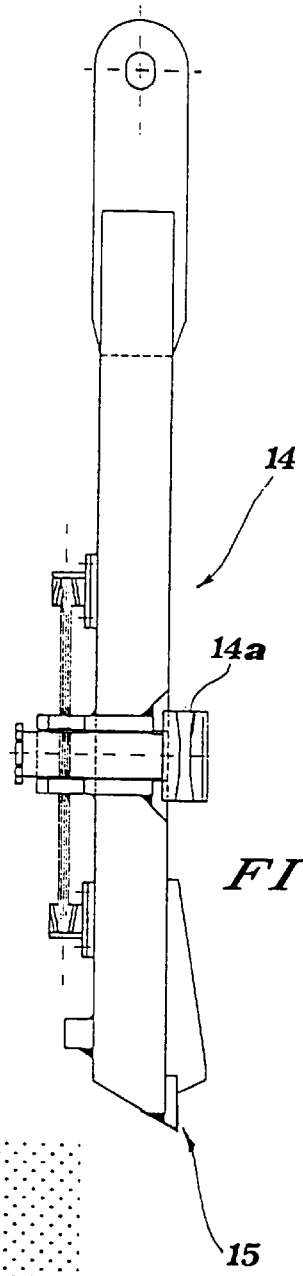
Figure 6:
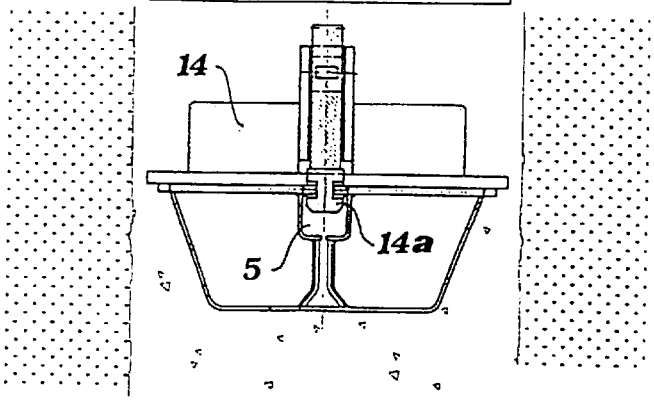
FIG. 6 is a cross-sectional view which shows the chisel according to FIG. 5 engaged with the stop-end pipe.

Once the excavation of the trench has been completed, as shown in FIGS. 5A and 5B, a special chisel device 14 is lowered along the stop-end pipe in order to clean off any residual fragments of earth and/or concrete which may have remained attached to the exposed surface of the stop-end pipe. In order to maintain perfect adhesion of a tip 15 on the chisel 14 to the surface of the stop-end pipe, in this case as well, a pawl 14*a* is provided, engaging in the guide channel 5 in FIG. 6.

By freeing the exposed surface of the stop-end pipe, the tension accumulated in the walls of the profiled section 1 and in the double partition 2 are also released. See FIGS. 1B and 1C. Thus, the re-acquired deformability about the hinge 6 of the profiled section is such as to allow easy separation thereof from the head end surface of the formed wall. In fact, as already mentioned above, although the double partition 2 confers the necessary rigidity to the profiled section 1 when the latter is subject to the compressive load of the concrete surrounding it, it does not offer any resistance to the mutual approach of the two shells 1*a* and 1*b* when the compressive load on the profiled section is released as a result of the set of the concrete and the freeing of the head end face 7.

Figure 2B:
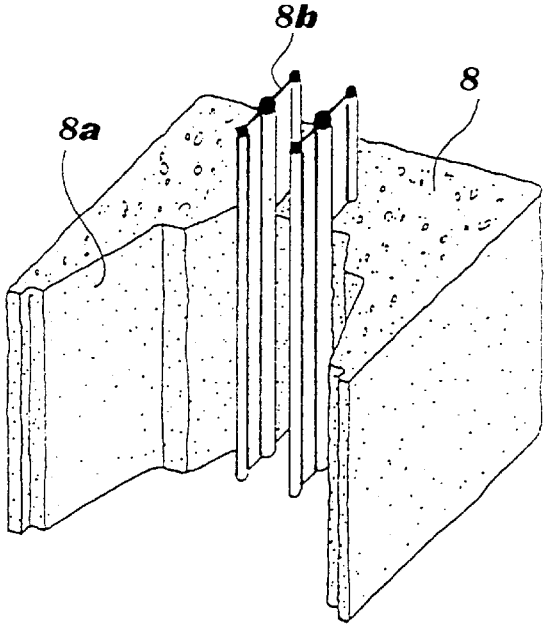

In order to extract the stop-end pipe from the concrete wall 8*a* in FIG. 2B, it is therefore sufficient to subject it to an axial pulling force by means of fastening to a tie-rod which acts on its upper end. The action of the raising tension, as opposed to the weight of the stop-end pipe, has the effect that the two shells 1*a* and in FIG. 1B move towards one another, bending about the hinge 6 and separating from the oblique joining surfaces 8*a* formed in the concrete casting.

If necessary, it is possible to facilitate this operation via means which, without impacts or pulsing actions, force the two shells 1*a* and 1*b* to bend towards one another, resulting in their separation from the surrounding concrete.

With the stop-end pipe according to the present invention, the objects stated in the introduction are therefore achieved. In particular, a stop-end pipe is provided, having a characteristic deformability which, by the mutual approach of the two shells which form it, allows easy separation of the set concrete casting by a simple axial pulling and raising action, but at the same time, owing to its structure and, in particular, the presence of the double reinforcing partition, is capable of withstanding the intense compressive stresses.

It is understood, however, that the invention is not limited to the particular configurations illustrated above, which form only nonlimiting examples of the scope of the invention, but that numerous variants are possible, all within the grasp of a person skilled in the art, but without thereby departing from the scope of the invention itself.

For example, although reference has always been made to a closed double-shell profiled section, the invention also embraces a trapezoidal profiled section in which two wings are open and there is a simple reinforcing partition which prevents the collapse, under pressure, of the two bases of the trapezium one over the other.

Moreover, in the description provided above, reference has been made to use of the stop-end pipe according to the invention for lateral definition of a concrete casting, during the construction of underground walls by an excavation technique using bentonite slurry, but is it is obvious that this profiled section may also be used in any other application where there is a problem of separation of the formwork from the hardened casting.

What is claimed is:

1. A stop-end pipe for formation of joining surfaces between adjacent wall elements made from concrete cast inside excavations, comprising a profiled section of substantially trapezoidal shape having at least two wings, said wings being resiliently deformable by approaching one towards the other.

2. The stop-end pipe as recited in claim 1, further comprising at least an internal double reinforcing longitudinal partition.

3. The stop-end pipe as recited in claim 2, in which said wings are in the form of two closed shells joined by a deformable common wall.

4. The stop-end pipe as recited in claim 3, in which said double partition forms part of the two closed shells.

5. The stop-end pipe as recited in claim 4, in wihch the two closed shells are able to approach one another by rotating about a hinging zone situated in correspondence with the deformable common wall.

6. The stop-end pipe as recited in claim 5, in which said double partition partially widens out, in correspondence with a larger base of said profiled section, to form a guide channel in which a guiding pawl of a working tool is insertable.

7. The stop-end pipe as recited in claim 6, in which said double partition partially widens out, in correspondence with the deformable common wall, to form a Y-shaped structure having edges which are joined to the deformable common wall.

8. The stop-end pipe as recited in claim 6, further comprising a protective board of breakable material applied onto the larger base of said profiled section.

9. The stop-end pipe as recited in claim 6, further comprising a box-shaped formwork, wider than the profiled section, applied removably onto the larger base of said profiled section.

10. The stop-end pipe as recited in claim 6, in which a breakable disposable tube is housed inside the guide channel.

11. The stop-end pipe as recited in claim 4, further comprising a removable formwork with a retractor tool to be inserted between the two closed shells.

12. The stop-end pipe as recited in claim 1, in which said profiled section has, associated with one of the adjacent wall elements made from concrete, a seating for provisionally retaining sealing strips for water-tightness of a joining surface with the concrete.

* * * * *